United States Patent [19]

Mack

[11] Patent Number: 4,648,802

[45] Date of Patent: Mar. 10, 1987

[54] RADIAL FLOW ROTOR WITH INSERTS AND TURBINE UTILIZING THE SAME

[75] Inventor: Thomas E. Mack, Villa Park, Calif.

[73] Assignee: PDA Engineering, Santa Ana, Calif.

[21] Appl. No.: 648,010

[22] Filed: Sep. 6, 1984

[51] Int. Cl.[4] ..... B63H 1/28; B64C 11/14; F01D 5/00; F03B 1/02

[52] U.S. Cl. ..... 416/244 A; 415/205

[58] Field of Search ..... 416/218, 230 R, 241 A, 416/244 A, 186 R; 415/203, 205, 213 B

[56] References Cited

U.S. PATENT DOCUMENTS

| | | | |
|---|---|---|---|
| 3,037,742 | 6/1962 | Dent et al. | 416/244 A |
| 3,532,439 | 10/1970 | Palfreyman et al. | 416/230 |
| 3,625,634 | 12/1971 | Stedfield | 416/218 |
| 4,086,760 | 5/1978 | Chute | 60/39.75 |
| 4,465,434 | 8/1984 | Rourk | 416/230 |

FOREIGN PATENT DOCUMENTS

| | | | |
|---|---|---|---|
| 503024 | 4/1976 | U.S.S.R. | 416/230 |

*Primary Examiner*—Carlton R. Croyle
*Assistant Examiner*—Donald E. Stout
*Attorney, Agent, or Firm*—Gordon L. Peterson

[57] ABSTRACT

A rotor for high temperature and high speed applications including a rotatable hub, a plurality of rotor blades mounted on the hub for rotation therewith, and a shroud coupled to the rotor for rotation therewith and lying radially outwardly of at least a portion of the blades so that, upon rotation of the rotor, the shroud is unevenly deformed due to the centrifugal force resulting from the mass of the blades. This uneven deformation of the shroud places it in shear. The shroud is stronger in hoop tension than in shear. Centrifugal members are positioned between adjacent blades to apply a centrifugal force to the shroud between the blades. This causes the shroud to be more evenly deformed to reduce the shear.

4 Claims, 7 Drawing Figures

RADIAL FLOW ROTOR WITH INSERTS AND TURBINE UTILIZING THE SAME

BACKGROUND OF THE INVENTION

Some turbines must operate at extremely high temperatures and at very high angular velocities. For example, turbines of the type employed in intercontinental cruise missiles or tactical missiles may operate at temperatures up to 3500 degrees F. and have a blade tip speed or tangential velocity of about 2000 feet per second.

The high angular velocities of the turbine rotor produces high centrifugal force. The strength of many materials reduces drastically at temperatures at or below 3500 degrees F. Accordingly, there are very few known materials which can be used in the rotor of a turbine of this kind. In fact, material selection is essentially limited to a few ceramics and a composite material known as carbon/carbon. Carbon/carbon comprises a carbon matrix with carbon fibers oriented to obtain the desired directional strength characteristics. The carbon is coated in accordance with known practice to prevent the carbon from oxidizing at high temperatures.

A rotor for a turbine of this kind typically includes a rotatable hub, rotor blades mounted on the hub and a shroud rotatable with the rotor and lying radially outwardly of a portion of the blades. One problem with this construction is that the shroud tends to fail when the rotor is spun at high angular velocities.

SUMMARY OF THE INVENTION

This invention solves the problem of shroud failure. This is accomplished without strengthening the shroud.

Upon rotation of the rotor, the centrifugal force resulting from the mass of the shroud places the shroud in hoop tension. In addition, the centrifugal force resulting from the mass of the blades places discrete or local forces on the shroud that locally deform the shroud radially outwardly of each of the blades. Thus, the shroud is unevenly deformed, and this uneven deflection of the shroud places the shroud in shear.

Because the rotor spins at high velocities, the centrifugal force applied to the shroud is very high. Accordingly, the shroud is constructed so as to be very strong in hoop tension, and it is much stronger in hoop tension than in shear. Because of the high-temperature service requirements, the shroud is constructed of a composite material, such as carbon/carbon, and the carbon fibers are arranged to provide high strength in hoop tension. Unfortunately, there is insufficient room in the composite material, after providing adequate fibers in the hoop and axial directions for the strength needed in these directions, to provide the desired shear strength. Accordingly, the shroud is relatively weak in shear. Consequently, the shear forces resulting from the uneven deformation of the shroud tend to cause destruction of the shroud.

To solve the problem, this invention provides means responsive to rotation of the hub for applying a centrifugal force to the shroud between the blades to cause the shroud to be more evenly deformed. This reduces the shear on the shroud so that the shroud does not fail in shear. Of course, the centrifugal force applied between the blades increases the hoop tension on the shroud. It is quite surprising that increasing the hoop tension forces could be used to safeguard the shroud against failure. In this instance, the shroud is capable of resisting these additional hoop tension forces.

One advantageous way of applying the centrifugal force includes placing a centrifugal member between a pair of adjacent blades and between the shroud and the hub. To obtain more even deformation around the circumference of the shroud, a centrifugal member is preferably placed between each pair of adjacent blades.

Ideally, the centrifugal member would have a mass and a spacing from the axis of the rotor that would create a centrifugal force equal to the centrifugal force exerted by the adjacent blade. However, in practice, this is not possible for a high-temperature rotor because the blades are relatively large and there are no presently known suitable high density, high temperature resistant materials. Accordingly, in practice of the invention using presently available materials, the uneven distortion of the shroud is reduced but not totally eliminated. Thus, the shear on the shroud is reduced but not totally eliminated. However, the shear is reduced to an acceptable level which can be accommodated by the shroud.

This invention is particularly adapted for application to a radial flow rotor which comprises a rotatable hub having a plurality of circumferentially spaced slots and a plurality of blades, with each of the blades having a mounting portion received in the slots, respectively, so that the blades can rotate with the hub. The blades are adapted to have high temperature gases pass thereover, and if the rotor is used in a turbine, the gases rotate the hub. If the rotor is used in a compressor the rotor is rotated by a motor to cause the blades to compress the gases flowing over the blades.

The shroud is coupled to the rotor and lies radially outwardly of portions of the blades so that centrifugal force resulting from the mass of the shroud places the shroud in hoop tension, and centrifugal force from the mass of the blades places local or discrete forces on the shroud that tend to locally deform the shroud radially of each of the blades to place the shroud in shear as described above. Each of the blades preferably has a radial segment extending generally radially outwardly from the mounting portion, and the shroud includes an inlet segment and an outlet segment on opposite sides of the radial segments of the blades. The centrifugal segments which reduce the shear load, are between the hub and the shroud.

The invention, together with additional features and advantages thereof, may best be understood by reference to the following description taken in connection with the accompanying illustrative drawing.

DESCRIPTION OF THE PREFERRED EMBODIMENT

Figure 1:
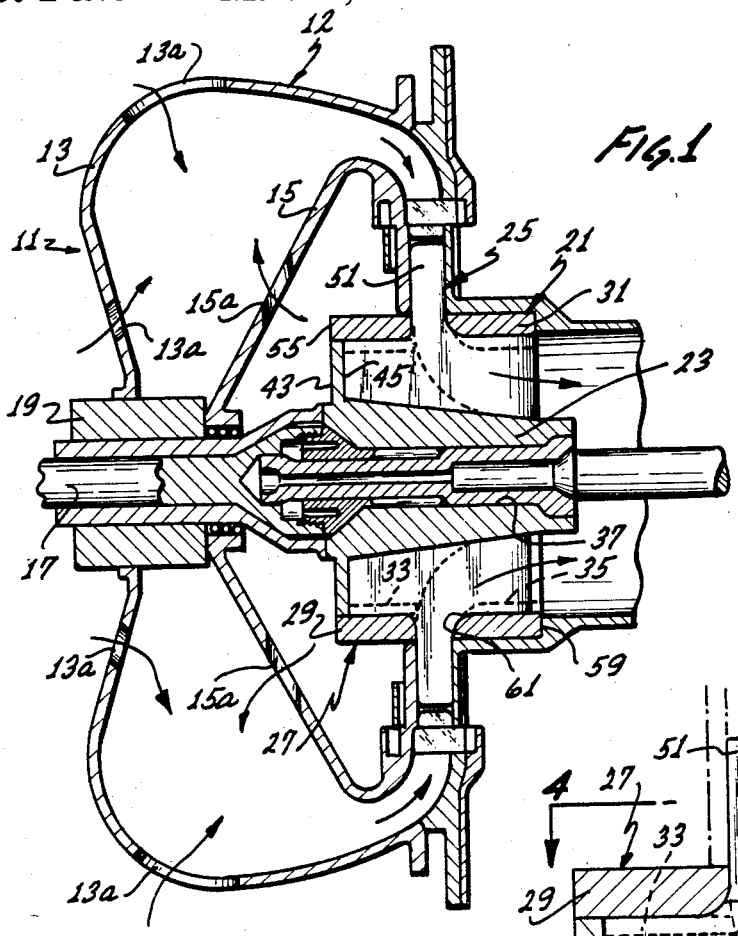
FIG. 1 is an axial sectional view of a turbine constructed in accordance with the teachings of this invention.

FIG. 1 shows a turbine 11 which comprises a housing 12 having an outer combustor 13 with openings 13*a*, an inner combustor 15 with openings 15*a* and stator vanes therein. The turbine 11 also includes a rotatable turbine shaft 17 appropriately mounted in a bearing 19 on the housing 12 and a rotor 21. Except for the rotor 21, the turbine 11 may be of conventional construction and may be of the type employed in tactical missiles or intercontinental cruise missiles. As such, the turbine 11 is used in a high-temperature, high-speed application.

Figure 2:
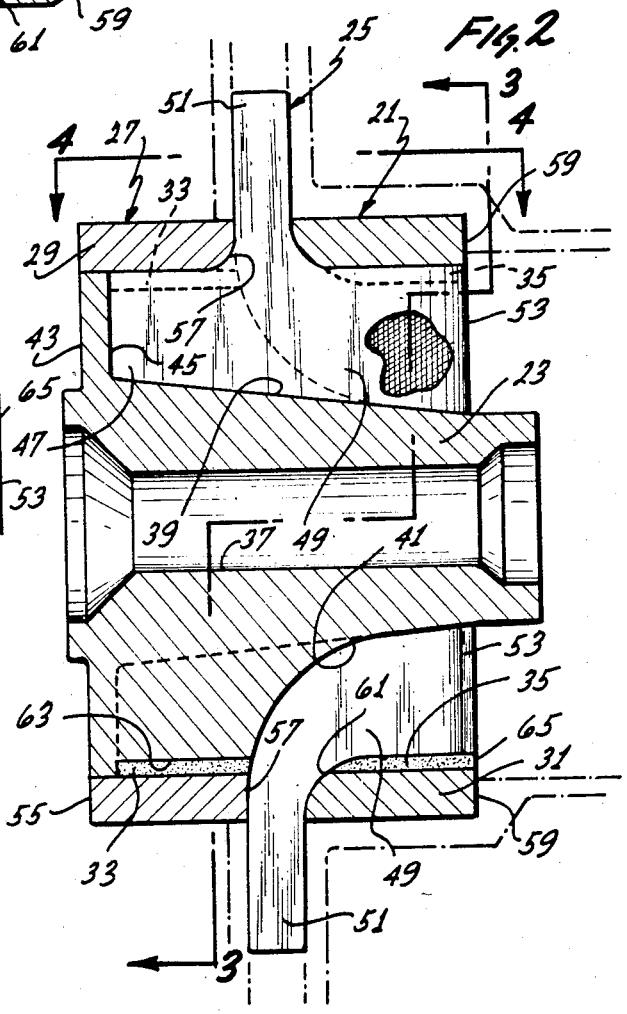
FIG. 2 is an enlarged axial sectional view of the rotor and adjacent portions of the turbine.
Figure 3:
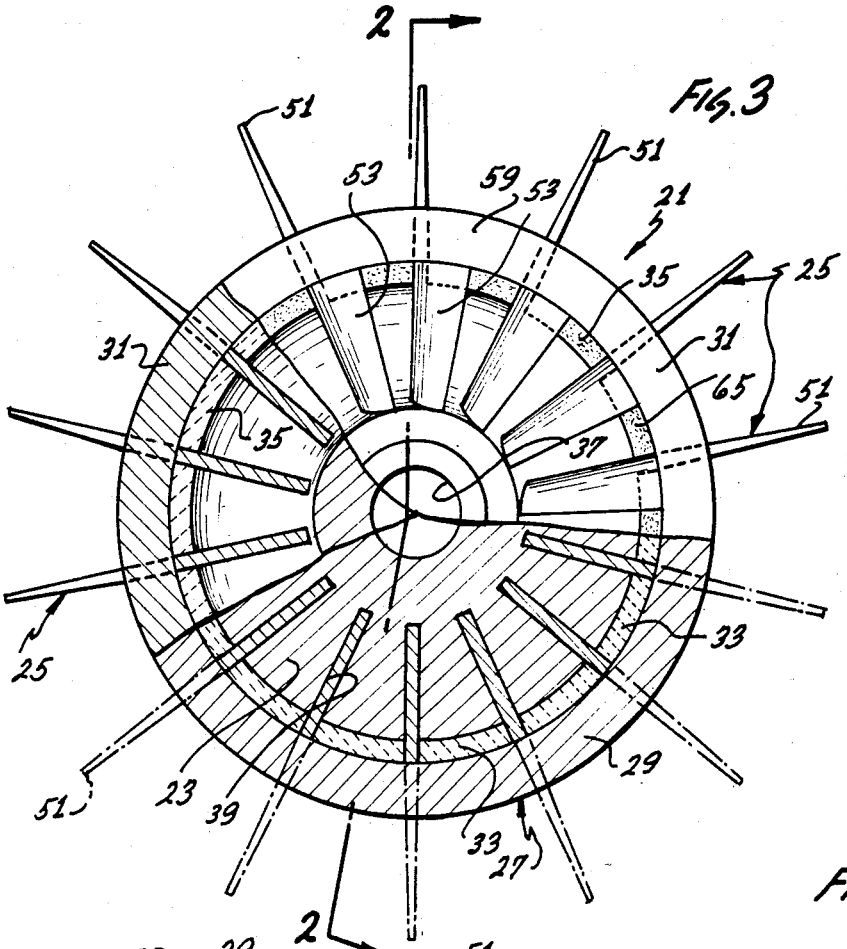
FIG. 3 is a sectional view taken generally along line 3—3 of FIG. 2

With reference to FIG. 2, the rotor 21 comprises a hub 23, turbine blades 25, a shroud 27 composed of an inlet segment 29 and an outlet segment 31, and inlet centrifugal members 33 and outlet centrifugal members 35. Each of the components of the rotor 21 is constructed of high-temperature materials capable of withstanding up to 3500 degrees F. In this regard, the hub 23, the blades 25 and the shroud 27 are constructed of carbon/carbon, and the centrifugal members 33 are constructed of carbon/carbon, an appropriate ceramic or tungsten.

The hub 23 has an axial passage 37 through which the shaft 17 extends, and the hub is appropriately mounted on the shaft 17 for rotation therewith. The hub 23 also has a series of circumferentially spaced, axially extending slots 39 that extend from a curved trailing surface 41 of the hub toward an inlet end 43 and terminates short of the inlet end such that each of the slots is closed by a web 45. The slots 39 open at the periphery or circumference of the hub 23, and the radial dimension of the slots decreases as the slots extend toward the associated webs 45.

Figure 5:
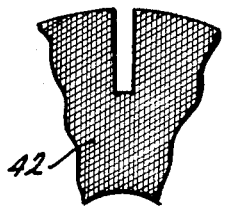
FIGS. 5 and 6 are sectional views taken on a radial plane through the hub to illustrate the adjacent plies of the hub. The blade is removed in FIG. 5.
Figure 6:
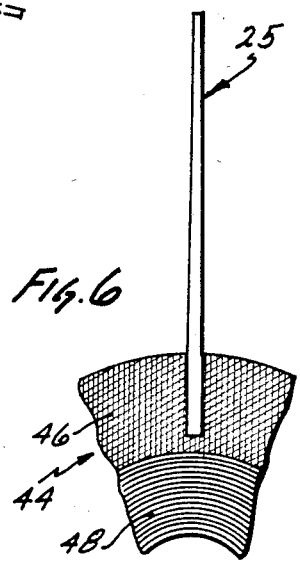
Figure 7:
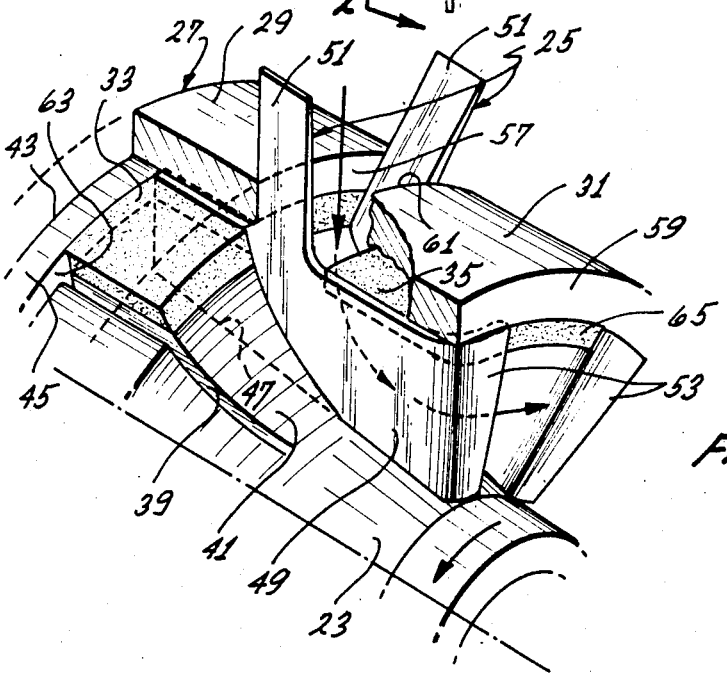
FIG. 7 is a fragmentary isometric view partially in section illustrating a portion of the rotor.

The hub 23 is constructed of a high-temperature, high-strength material, and coated carbon/carbon is preferred. For example, the hub may be constructed of alternating plies 42 and 44 (FIGS. 5 and 6) of carbon/carbon of somewhat different construction. For example, each of the plies 42 comprises a layer of carbon/carbon fabric with each of the fabric layers comprising warp and fill strands oriented to define about a 90 degree angle. Each of the plies 44 includes an outer, annular region 46 of a fabric layer substantially identical to the fabric layer of the ply 42 and an inner region 48 comprising carbon/carbon tape spirally wound. The carbon/carbon tape consists of longitudinally extending carbon fibers. The regions 46 and 48 form a single layer. The fabric of the ply 42 and the outer region 46 are oriented so that the fill strands are at 0 degrees, 60 degrees and minus 60 degrees in any three successive layers. The plies 42 and 44 are held together in a carbon matrix in accordance with known practice. The outer, annular region 46 has a sufficient radial dimension to completely contain the slots 39.

Figure 4:
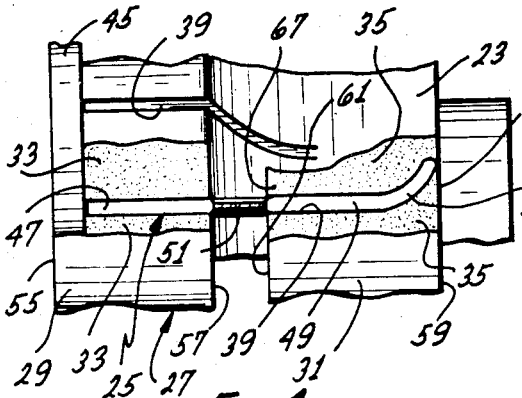
FIG. 4 is a fragmentary view taken generally along line 4—4 of FIG. 2.

Each of the blades 25 may be identical. In the embodiment illustrated, each of the blades has a mounting portion 47, an exit segment 49 and a radial segment 51 projecting radially outwardly from a location adjacent the junction of the mounting portion and the exit segment. The exit segment 49 has a curved tip portion 53 (FIG. 4). The mounting portions 47 of the blades 25 are received, respectively, within the slots 39 of the hub 23. In this position, the mounting portion 47 engages the web 45, and the juncture between the mounting portion 47 and the exit segment 49 lies generally along the exit end 41 of the hub 23. The mounting portion 47 is suitably retained within the slots 39. The mounting portion 47 serves to mount the associated blade 25 and to reduce the tendency of the blades 25 to rotate due to centrifugal force.

Each of the blades 25 may be constructed of coated carbon/carbon of any suitable architecture. For example, each of the blades 25 may be constructed of alternating carbon fabric layers having the warp and fill strands thereof oriented at 90 degrees to each other, with the strands of each layer being offset 45 degrees from the adjacent ply.

The inlet segment 29 of the shroud 27 and the outlet segment 31 of the shroud are each annular, cylindrical members which completely surround the hub 23. The inlet segment 29 has an inlet end 55 which is flush with the inlet end 43 of the hub 23 and a trailing end 57 which engages the radial segments 51 of the blades 25. Similarly, the outlet segment 31 has a trailing end 59 which is flush with the end of the tip portions 53 of the blades 25 and a curved leading end 61 which engages the radial segments 51 of the blades 25. As shown in FIG. 2, the radial segments 51 project radially outwardly of the shroud 27. The shroud 27 is suitably mounted for rotation with the hub 23.

Because of the high angular velocity of the rotor 21 and the relatively long radial distance between the spin axis of the rotor and the shroud 27, the shroud experiences substantial centrifugal force due to its own mass. For this reason, the shroud 27 must be constructed so as to be very strong in hoop tension. To accommodate this strength requirement, as well as the requirement that the shroud be capable of withstanding temperatures up to about 3500 degrees F., the shroud is preferably constructed of coated carbon/carbon. In addition, the fabric layers of the carbon/carbon must be arranged to provide substantial hoop tension strength. A requirement for high strength in hoop tension is further necessitated because the centrifugal force resulting from the blades 25 is transmitted to the shroud 27. Although various carbon/carbon architectures can be employed, in one preferred construction, the inlet segment 29 and the outlet segment 31 of the shroud 27 each comprise circumferentially wound layers of carbon/carbon fabric having perpendicular strands, with the strands extending in the hoop direction having six times the volume as the strands extending in the axial direction. This provides for relatively high strength in hoop tension, and lesser strength in the axial direction. Moreover, the shroud 27 has relatively low interlaminar shear strength.

If the centrifugal members 33 and 35 were not provided, the centrifugal force resulting from the blades 25 would cause the inlet segment 29 and the outlet segment 31 of the shroud 27 to tend to deform unevenly in that greater radial outward deformation would occur in the shroud directly radially outwardly of each of the blades 25 than would occur between the blades. This uneven deflection of the shroud 27 would produce interlaminar shear forces that would tend to delaminate the layers of the carbon/carbon material of the shroud 27. The centrifugal members 33 and 35 are provided for the purpose of reducing this shear force.

The centrifugal members 33 are identical to each other, and the centrifugal members 35 are also identical to each other. Each of the centrifugal members 33 and 35 is in the form of a portion of a cylindrical sleeve which has a circumferential dimension equal to the circumferential spacing between adjacent blades 25.

The centrifugal members 33 and 35 in the embodiment illustrated are constructed of a suitable temperature resistant ceramic.

The centrifugal members 33 and 35 are positioned between the hub and the shroud 27. Specifically, the centrifugal members 33 are sandwiched directly between the hub 23 and the inlet segment 29 of the shroud 27. Each of the centrifugal members 33 extends circumferentially completely between the mounting portion 47 of one blade 25 to the mounting portion 47 of the adjacent blade and may be in contact therewith. In the axial direction, each of the centrifugal members 33 extends from the associated blades 25 to the radial outer portion of the web 45 as shown in Fig. 2. More specifically, the hub 23 defines a series of grooves 63 between adjacent slots 39 in which the centrifugal members 33 are seated, respectively.

The centrifugal members 35 extend circumferentially between the exit segments 49 of adjacent blades 25. Each of the centrifugal segments 35 has a trailing end 65 which is flush with the trailing end 59 and with the end of the tip portion 53 of the adjacent blades 25 and a leading end 67. Each of the segments 35 is also curved as shown in FIG. 4 to accommodate the curvature of the tip portion 53 of the adjacent blades 25.

In assembling the rotor 21, centrifugal members 33 are placed in the associated grooves 63, and the mounting portions 47 are inserted in the slots 39 of the hub 23. The centrifugal members 35 are next inserted, and the inlet segment 29 and the outlet segment 31 of the shroud 27 are then placed over the hub 23 as shown in FIG. 2. The hub 23, blades 25 and shroud 27 of the rotor 21 are fused together in a final carbon/carbon processing step in which the rotor 21 is heated so that the coating on the carbon/carbon, which may be a phenolic, fuses these components together. Similarly, the centrifugal members may be attached to the shroud 27 in the same heating operation by precoating these members with a suitable coating, such as a phenolic.

In use of the turbine 11, the rotor 21 spins at a high velocity which may provide the blades 25 with a tip speed of 2000 feet per second, and the rotor is subjected to hot gases from the combustor 13 that may raise the temperature of the rotor to about 3500 degrees F. The gases from the combustor 13 flow radially inwardly across the radial segments 51 of the blades 25, and they are discharged from the rotor 21 at the tip portions 53 of the blades 25. To this extent, the turbine 11 and the rotor 21 function in a conventional manner.

The mass of the shroud 27 and of the blades 25 places large centrifugal forces on the shroud 27 as the rotor rotates. This places large hoop tension forces on the shroud 27, and the centrifugal force resulting from the mass of the blades 25 places local radial outward forces on the shroud 27 that tends to locally deform the shroud 27 radially outwardly of each of the blades 25. However, the centrifugal members 33 and 35 provide centrifugal force to the inlet segment 29 and the outlet segment 31, respectively, of the shroud 27 as the rotor rotates. This causes the segments 29 and 31 of the shroud 27 to be more evenly deformed to reduce the shear forces on the segments of the shroud. Consequently, the shroud 27 is much less likely to fail in shear, and the additional hoop tension forces placed on the shroud 27 can be withstood by the shroud 27.

Although an exemplary embodiment of the invention has been shown and described, many changes, modifications and substitutions may be made by one having ordinary skill in the art without necessarily departing from the spirit and scope of this invention.

I claim:

1. A rotor for high temperature and high speed applications comprising:

a rotatable hub having a plurality of circumferentially spaced slots;

a plurality of blades, each of said blades having a mounting portion, said mounting portions being received in said slots, respectively, whereby the blades rotate with the hub, said blades being adapted to have high-temperature gases pass thereover; a shroud coupled to the hub and rotatable therewith, said shroud extending over said slots and said mounting portions whereby centrifugal force resulting from the mass of the shroud places the shroud in hoop tension and centrifugal force resulting from the mass of the blades places local forces on the shroud that tend to locally deform the shroud radially of each of the blades to place the shroud in shear;

said shroud being constructed of a composite material arranged so that the shroud is stronger in hoop tension than in said shear;

means responsive to rotation of the hub for applying a centrifugal force to the shroud between said blades to cause the shroud to be more evenly deformed to thereby reduce said shear; and each of said blades having a radial segment extending generally radially outwardly, said shroud having an inlet segment and an outlet segment on opposite sides of the radial segments of the blades, and a plurality of centrifugal members between the hub and the shroud, some of said members being one one side of said radial segments of said blades and the other of said members being on the other side of said radial segments of said blades, and each of said members being between an adjacent pair of said blades.

2. A rotor as defined in claim 1 wherein said radial segment of each of said blades projects radially outwardly from the mounting portion of such blade intermediate the ends of the blade.

3. A rotor as defined in claim 1 wherein said shroud is constructed of a material capable of withstanding about 3500 degrees F.

4. A rotor as defined in claim 1 wherein said shroud is constructed of a carbon-carbon composite material comprising carbon fibers in a carbon matrix arranged to provide greater strength in hoop tension than in shear.

* * * * *